US009108426B2

(12) United States Patent
Tsuchiya et al.

(10) Patent No.: US 9,108,426 B2
(45) Date of Patent: Aug. 18, 2015

(54) INKJET PRINTING APPARATUS AND INKJET PRINTING METHOD

(71) Applicant: CANON KABUSHIKI KAISHA, Tokyo (JP)

(72) Inventors: Okinori Tsuchiya, Kawasaki (JP); Tohru Ikeda, Yokohama (JP); Akihiko Nakatani, Kawasaki (JP); Takashi Fujita, Kawasaki (JP); Hiromitsu Akiba, Yokohama (JP); Takeru Sasaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/310,467

(22) Filed: Jun. 20, 2014

(65) Prior Publication Data

US 2015/0002569 A1 Jan. 1, 2015

(30) Foreign Application Priority Data

Jun. 27, 2013 (JP) ..... 2013-135009

(51) Int. Cl.
*B41J 2/21* (2006.01)
*B41J 2/045* (2006.01)

(52) U.S. Cl.
CPC ..... *B41J 2/2103* (2013.01); *B41J 2/0458* (2013.01); *B41J 2/04528* (2013.01); *B41J 2/04563* (2013.01); *B41J 2/04581* (2013.01)

(58) Field of Classification Search
CPC ..... B41J 2/2107; B41J 2/2132; B41J 2/2052; C09D 11/322; C09D 11/40
USPC ..... 347/15, 43
See application file for complete search history.

(56) References Cited

U.S. PATENT DOCUMENTS

| | | | | |
|---|---|---|---|---|
| 5,907,332 | A | 5/1999 | Fujita et al. | |
| 6,517,177 | B2 * | 2/2003 | Moto et al. | 347/14 |
| 6,789,867 | B2 | 9/2004 | Takahashi et al. | |
| 7,216,947 | B2 * | 5/2007 | Kusunoki | 347/9 |
| 7,367,643 | B2 * | 5/2008 | Furuichi et al. | 347/15 |
| 8,711,453 | B2 | 4/2014 | Yamada et al. | |
| 8,743,420 | B2 | 6/2014 | Ishikawa et al. | |
| 2012/0081436 | A1 | 4/2012 | Yamada et al. | |
| 2013/0300785 | A1 | 11/2013 | Tsuchiya et al. | |
| 2013/0301065 | A1 | 11/2013 | Nakatani et al. | |
| 2014/0184676 | A1 | 7/2014 | Yamada et al. | |

FOREIGN PATENT DOCUMENTS

JP 4343481 A 10/2009

* cited by examiner

*Primary Examiner* — Thinh Nguyen
(74) *Attorney, Agent, or Firm* — Fitzpatrick, Cella, Harper & Scinto

(57) ABSTRACT

In an inkjet printing apparatus, the colors of ink dots are controlled to make it possible to change the colors of an image to be printed. More specifically, ink temperatures, ink permeation speeds, and the capillary occupancy rates of inks in a print medium are used to control a permeation area formed by performing printing with preceding cyan and subsequent magenta, thereby controlling the colors realized by the inks which are ejected in an overlapping manner.

23 Claims, 11 Drawing Sheets

INKJET PRINTING APPARATUS AND INKJET PRINTING METHOD

BACKGROUND OF THE INVENTION

1. Field of the Invention

The present invention relates to an inkjet printing apparatus and a printing method therefor, and particularly relates to controlling the color of an ink dot to be printed with a plurality of types of inks in an overlapping manner.

2. Description of the Related Art

It is known that in an inkjet printing method, the color (color appearance) of a dot on a print medium which is printed with a plurality of color inks in an overlapping manner varies depending on the order in which these inks are ejected and an ejection time difference. Japanese Patent No. 4343481 discloses that nozzles for ejecting a plurality of color inks are placed at different positions in a conveyance direction of a print medium to have the same order in which the plurality of inks are ejected, and to keep constant an ejection time difference between the plurality of inks in any scan area. This can suppress a color difference.

However, the technique for reducing a color difference as disclosed in Japanese Patent No. 4343481 is basically to have the same order in which inks of different colors are overlapped (ejected). Accordingly, it is necessary to provide print heads having a specific nozzle arrangement and specialize a printing operation including a scan with the print heads and conveyance of a print medium, and it is difficult to carry out the technique disclosed in Japanese Patent No. 4343481 by using print heads and a printing operation which are generally and widely used. On the other hand, in a case where the colors of an image to be printed can be changed by not only maintaining the color appearance, but also controlling the color appearance to change the color, the degree of freedom of design of the image to be printed can be increased.

SUMMARY OF THE INVENTION

An object of the present invention is to provide an inkjet printing apparatus and a printing method therefor which can change the colors of an image to be printed by controlling the color appearance in the case of overlapping inks of different colors to perform printing.

In a first aspect of the present invention, there is provided an inkjet printing apparatus comprising: a print head unit for ejecting at least an ink of a first color and an ink of a second color different from the first color on a print medium; and a print control unit configured to control the print head unit to precedently eject the ink of the first color on the print medium and subsequently eject the ink of the second color on the ink of the first color precedently ejected on the print medium in an overlapping manner; wherein the print control unit controls the print head unit so that a permeation speed Ka at which the ink of the first color permeates the print medium is larger than a permeation speed Ka at which the ink of the second color permeates the print medium.

In a second aspect of the present invention, there is provided an inkjet printing method for performing printing by ejecting inks at least an ink of a first color and an ink of a second color different from the first color on a print medium by a print head unit comprising: precedently ejecting the ink of the first color on the print medium by the print head unit and subsequently ejecting the ink of the second color by the print head unit on the ink of the first color precedently ejected on the print medium in an overlapping manner; wherein the print head unit is controlled such that a permeation speed Ka at which the ink of the first color permeates the print medium is larger than a permeation speed Ka at which the ink of the second color permeates the print medium.

According to the above features, in the case of overlapping inks of different colors and performing printing, it becomes possible to control color appearance so as to change the colors of an image to be printed.

Further features of the present invention will become apparent from the following description of exemplary embodiments (with reference to the attached drawings).

DESCRIPTION OF THE EMBODIMENTS

Embodiments of the present invention will be described in detail below with reference to the drawings.

(First Embodiment)

Figure 1:
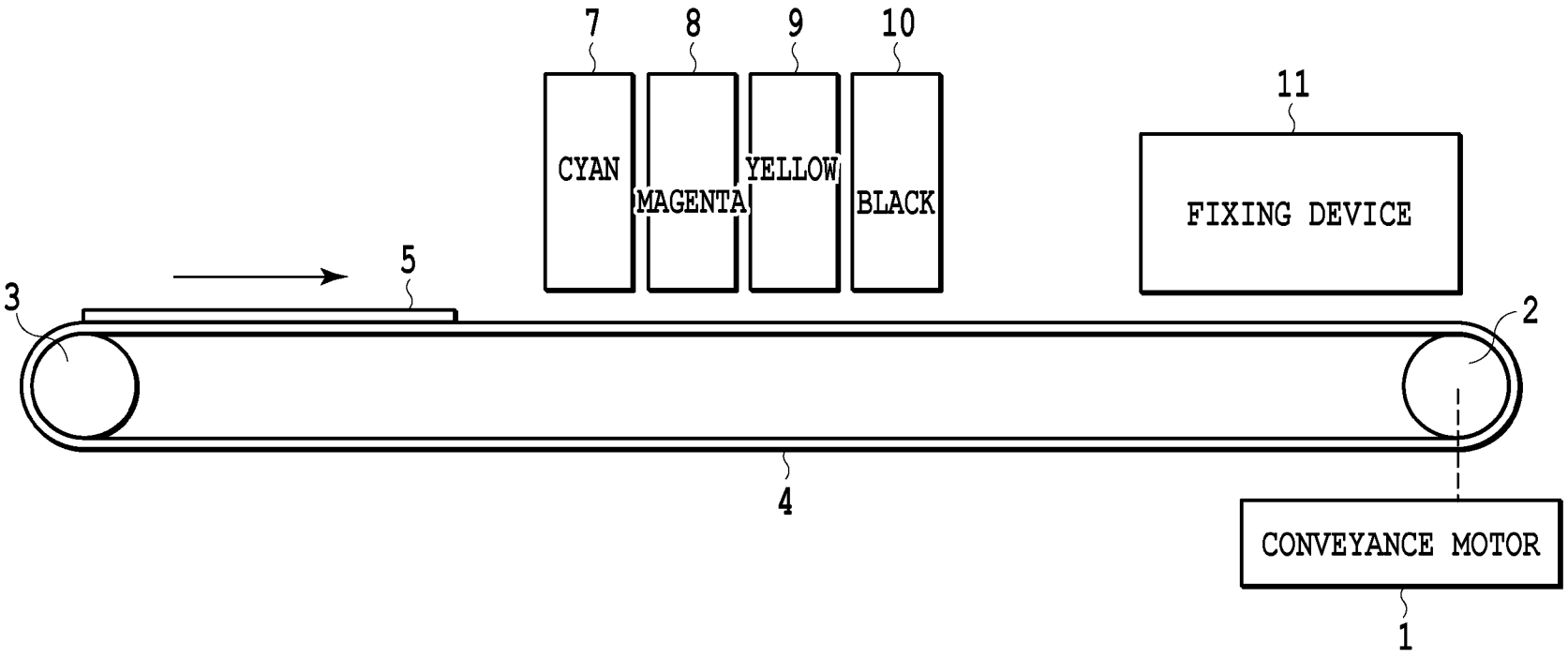
FIG. 1 is a diagram showing the schematic configuration of an inkjet printing apparatus according to an embodiment of the present invention as seen from a side.

FIG. 1 is a diagram showing the schematic configuration of an inkjet printing apparatus according to an embodiment of the present invention as seen from a side. As shown in FIG. 1, the printing apparatus of the present embodiment is a so-called full-line type printing apparatus, and print heads 7, 8, 9, and 10 for cyan (C), magenta (M), yellow (Y), and black (K) inks are arranged along a conveyance direction of a print medium. A print medium 5 is conveyed relative to these print heads whose positions are fixed. In the present embodiment, a distance between these print heads is 0.02 [m]. The above inkjet printing apparatus of the embodiment can print an image on one surface of the print medium by only passing one time the print medium below each print head.

A belt 4 is suspended between a driven roller 2 rotated by the driving force of a conveyance motor 1 and a driven roller 3 placed away from the roller 2, whereby the belt 4 runs. The print medium 5 such as paper is fed and mounted on the running belt 4, whereby the print medium 5 is conveyed. In FIG. 1, the left side of this conveyance path is an upstream side, and the print medium 5 is conveyed from the upstream side to the downstream side, and passes below the print heads 7, 8, 9, and 10 in this order. In this state, inks are ejected and land on the print medium in the order of the print heads 7, 8, 9, and 10 as seen from a certain area of the print medium. The print medium 5 comprises a base material portion made of a pulp or resin coat layer and an ink receiving layer made of one or more layers of silica or alumina. Ink droplets landing on the ink receiving layer permeate the receiving layer through a capillary which is made of voids of the receiving layer, and colorants such as dyes or pigments are fixed. A fixing device 11 is placed at a position in the downstream side which is a predetermined distance away from the print head 10 for the K ink in the most downstream side of the conveyance path. This fixing device 11 blows hot air toward the print medium 5 and dries and fixes a printed ink.

In the present embodiment, the print medium 5 is conveyed at a speed of 5 [m/sec] in a direction of an arrow in the conveyance path. Firstly, the first cyan print head 7 prints dots with a cyan ink. Then, the second magenta print head 8 prints magenta. Then, the third yellow print head 9 prints yellow. Finally, the fourth black print head 10 prints black. In a case where dot printing is completed, the print medium 5 is conveyed to the fixing device 11 and dried and fixed with hot air.

Figure 2:
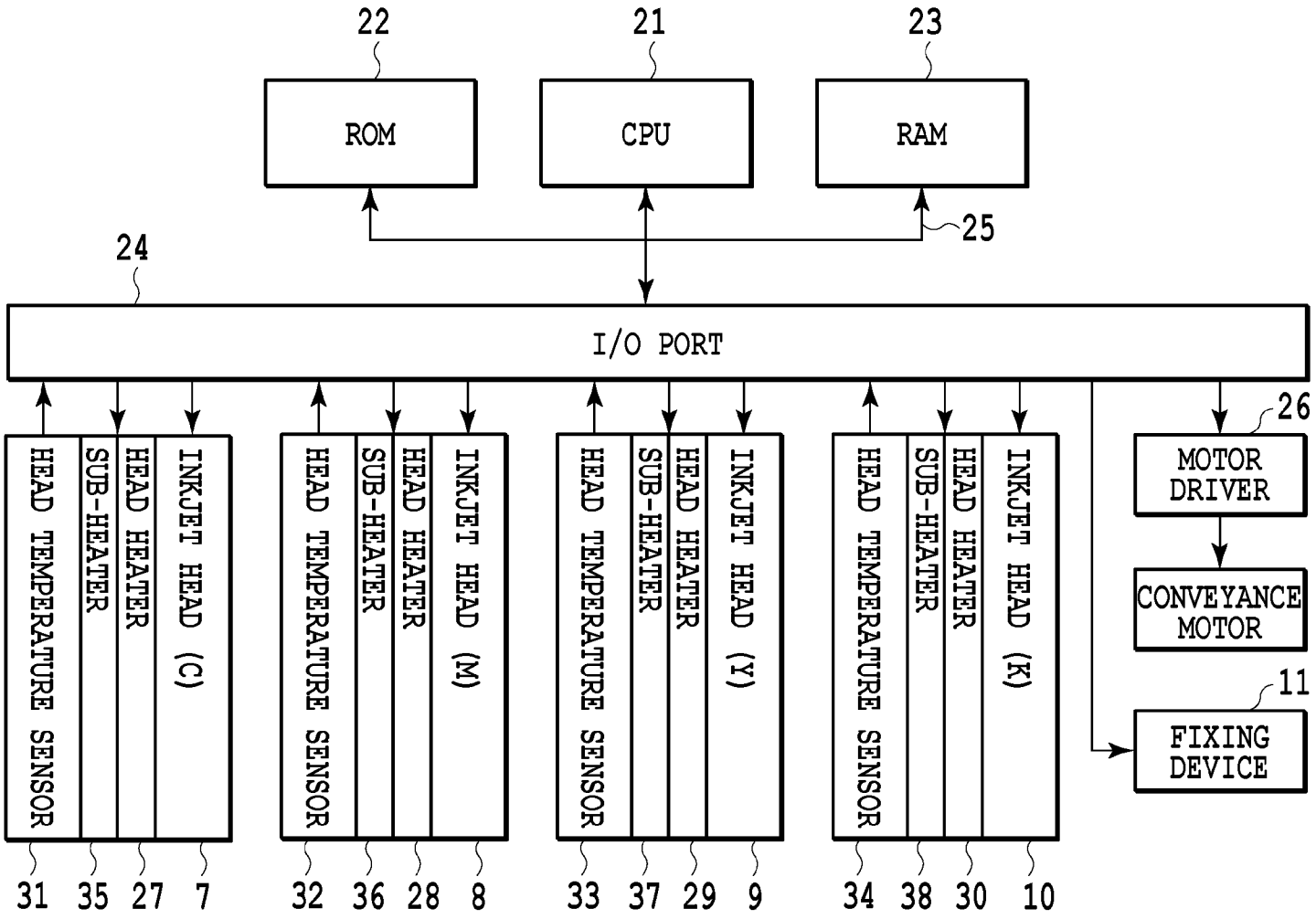
FIG. 2 is a block diagram showing the control configuration of the printing apparatus shown in FIG. 1.

FIG. 2 is a block diagram showing the control configuration of the printing apparatus shown in FIG. 1. As shown in FIG. 2, the control configuration of the present embodiment has a central processing unit (CPU) 21 included in a control section and a read-only memory 22 (ROM) having stored therein program data for enabling the CPU 21 to control each section. Further, the control configuration has a random access memory (RAM) 23 including a memory temporarily storing data for enabling the CPU 21 to control each section or a memory used for operation and an I/O port 24. The CPU 21, the ROM 22, the RAM 23, and the I/O port 24 are signal-connected via a bus line 25.

The I/O port 24 is connected to a motor driver 26 for driving the conveyance motor 1, the print heads (7, 8, 9, and 10), and the fixing device 11. In these print heads, ejection heaters (27, 28, 29, and 30) are respectively provided for nozzles for ejecting inks. The ejection heaters impart thermal energy necessary for ejecting inks. Further, the print heads are respectively provided with sub-heaters (35, 36, 37, and 38) for controlling the temperatures of inks in the nozzles. Furthermore, the print heads are respectively provided with temperature sensors (31, 32, 33, and 34) for detecting the temperatures of the print heads.

In the above configuration, the CPU 21 obtains the head temperatures detected by the temperature sensors (31, 32, 33, and 34). Further, the inks in the print heads (7, 8, 9, and 10) are heated by controlling the sub-heaters (35, 36, 37, and 38) to keep the inks at a predetermined temperature. The inks kept at the predetermined temperature are ejected by energizing the print head heaters (27, 28, 29, and 30). Ink heating by the sub-heaters adjusts the ink temperatures to control colors obtained by ejecting the inks on the same pixel of a print medium in an overlapping manner as will be discussed below.

In the above configuration, the cyan ink is firstly ejected from the print head 7 to the print medium 5 which is conveyed from the upstream side to the downstream side. Then, the magenta ink is ejected from the print head 8. Then, the yellow ink is ejected from the print head 9. Finally, the black ink is ejected from the print head 10. In this manner, the cyan (C), magenta (M), yellow (Y), and black (K) inks are ejected in this order, and are ejected (land) on pixels of the print medium 5. Incidentally, in the present embodiment, the sizes of ink droplets ejected from the nozzles of the print heads are 3 [pl].

Next, explanation will be made on control of a color appearance at the time of ejecting color inks on a certain pixel in an overlapping manner according to an embodiment of the present invention. For brevity, explanation will be made on the case of ejecting, in an overlapping manner, the cyan ink from the print head 7 and the magenta ink from the print head 8 out of the inks of the four colors.

The cyan ink from the print head 7 is always firstly ejected on the print medium to permeate the print medium. Thereafter, the magenta ink from the print head 8 is ejected. Hereinafter, the print head 7 for ejecting the cyan ink will also be referred to as "the preceding cyan head" and the print head 8 for ejecting the magenta ink will also be referred to as "the subsequent magenta head." Further, the cyan ink to be ejected precedently will also be referred to as "the preceding cyan," and the magenta ink to be ejected subsequently will also be referred to as "the subsequent magenta." In the present embodiment, an ejection time difference between the preceding cyan and the subsequent magenta is (a distance between the preceding cyan head 7 and the subsequent magenta head)/(a conveyance speed)=0.02 [m]/5 [m/sec]=4 [msec].

Regarding the printing order of the present embodiment, the preceding cyan and the subsequent magenta are always ejected in this order. Accordingly, in printing by a conventional technique, blue tinged with cyan is obtained, and a color reproducible area is large at a cyan side and small and distorted at a magenta side.

On the other hand, according to the embodiment of the present invention, a color appearance at the time of ejecting a plurality of inks in an overlapping manner is controlled regardless of the ejecting order. This can prevent color reproduction whose color gamut is distorted because of a color bias and also makes it possible to intentionally generate the color bias.

<Ideal State>

Firstly, the present inventors, et al. consider ideal ink permeation or an ideal permeation area which makes it possible to reproduce a color whose color gamut is not distorted.

Figure 3A:
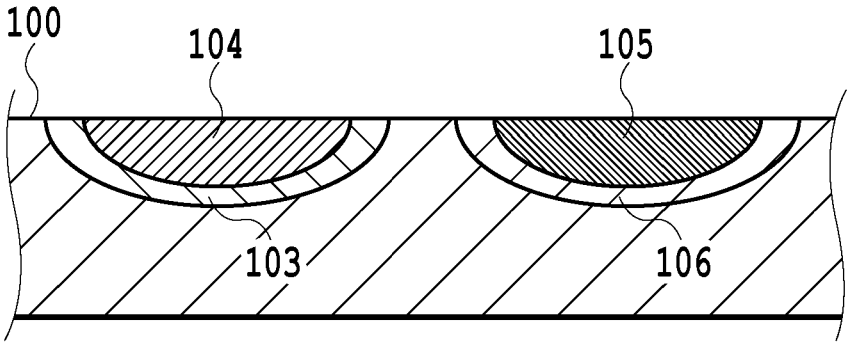
FIGS. 3A and 3B are diagrams showing an ink permeation area in a conventional example.
Figure 3B:
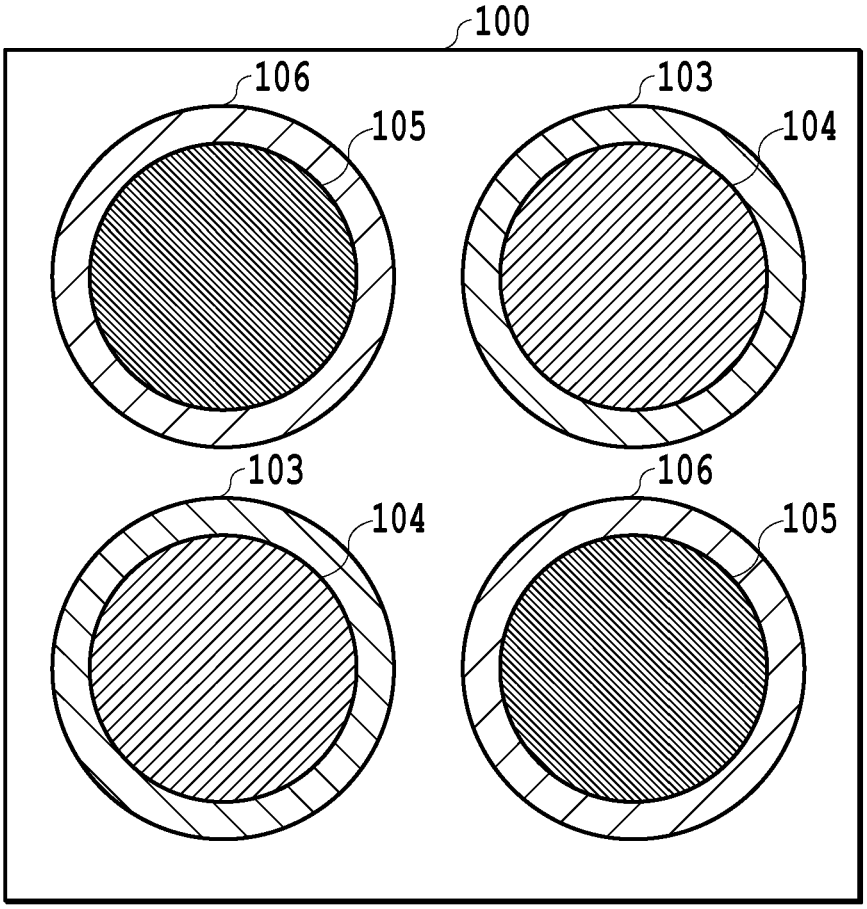

Explanation will be made on the case of printing dots in forward and backward scans of a print head according to a serial printing method different from the full-line printing method of the present embodiment. In this bidirectional printing, an ink permeates or a permeation area is formed as shown in FIGS. 3A and 3B. This makes it possible to reproduce a color whose color gamut is not distorted on a macro level as shown in FIG. 3B. More specifically, since the order in which inks are ejected in an overlapping manner is different between forward and backward scans, two types of permeation states occur as shown in FIG. 3A and there are formed a blue dot tinged with magenta (shown at the left side of FIG. 3A) which is made of preceding magenta 104 and subsequent cyan 103 and a dot tinged with cyan (as shown at the right side of FIG. 3A) which is made of preceding cyan 105 and subsequent magenta 106. Print control is performed so that the number of the dots tinged with magenta becomes substantially equal to the number of dots tinged with cyan. According to this print control, as shown in FIG. 3B, the number of dots tinged with cyan (upper left and lower right) becomes equal to the number of dots tinged with magenta (upper right and lower left) and these dots exist in a mixed state, on the paper. As a result, a color reproduction area which is not distorted on a macro level is realized. However, in a highlighted portion of a printed image where dots are printed sparsely, for example, both blue dots tinged with magenta (upper right and lower left) and blue dots tinged with cyan (upper left and lower right) are recognized on a micro level, and a problem of a color shift occurs.

In order to avoid the problem of a color shift which is found on a micro level, it is desirable that cyan and magenta inks permeate in a state in which the cyan ink and the magenta ink are fully mixed (colors are mixed). In a case where an ideal permeation area can be realized in which cyan and magenta inks permeate in a state in which the cyan ink and the magenta ink are fully mixed (colors are mixed), even in a case where a highlighted portion is observed on a micro level, only blue dots are observed and the color shift is not recognized.

Figure 4A:
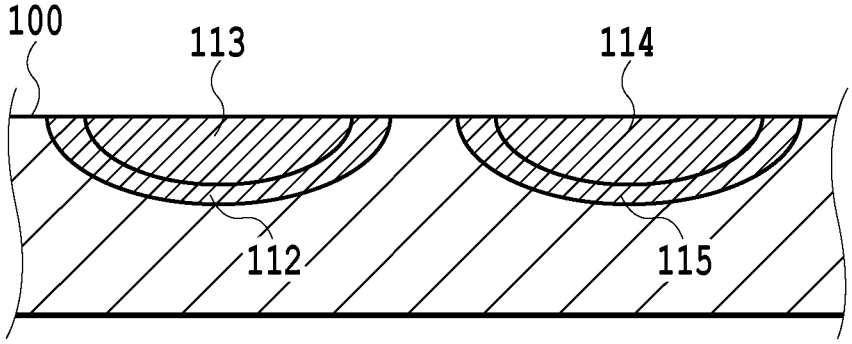
FIGS. 4A and 4B are diagrams schematically showing a permeation area in the case of performing printing in an ideal state according to an embodiment of the present invention.
Figure 4B:
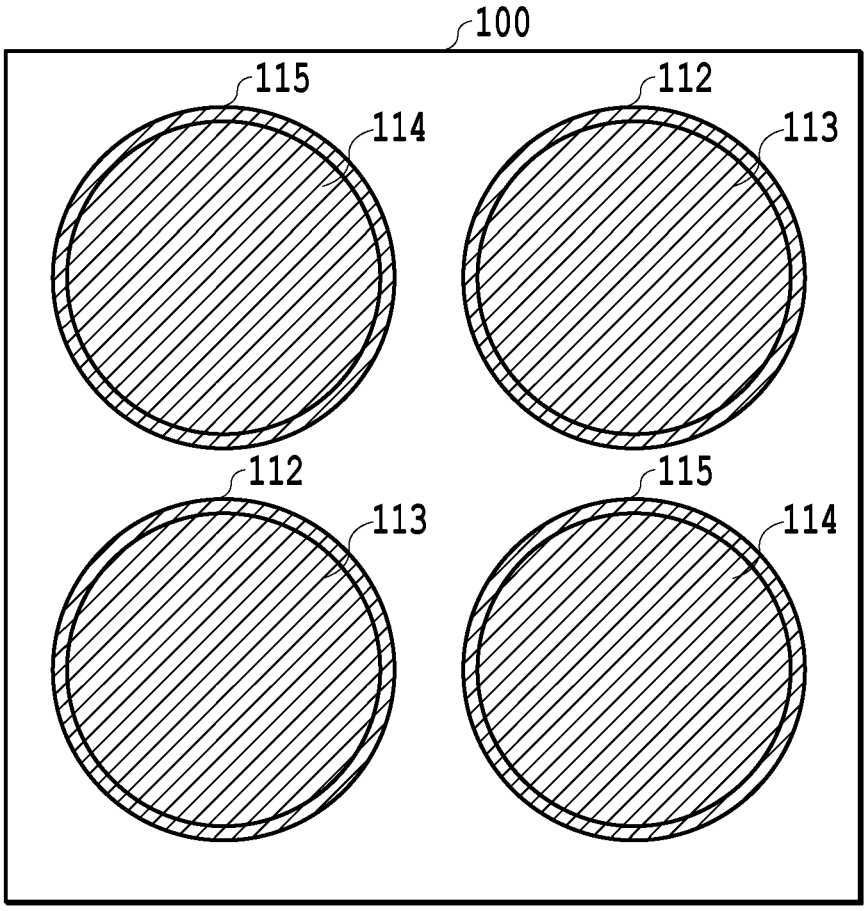

FIGS. 4A and 4B are diagrams schematically showing a permeation area in a case where printing is performed in the above ideal state. It should be noted that according to the present embodiment, only a combination of the preceding cyan and the subsequent magenta exists because of an arrangement order relationship among the print heads as stated above. However, a combination of the preceding magenta and the subsequent cyan will also be described below. These two combinations exist in a configuration in which the present invention is applied to a serial-type printing apparatus which will be described later as another embodiment.

The left side of FIG. 4A shows a permeation area in which preceding magenta 113 and subsequent cyan 112 permeate. Further, the right side of FIG. 4A shows a permeation area in which preceding cyan 114 and subsequent magenta 115 permeate. A state shown by this drawing is different from the one shown by FIG. 3A, and is the one in which a combination of the preceding magenta 113 and the subsequent cyan 112 and a combination of the preceding cyan 114 and the subsequent magenta 115 permeate in a state in which the cyan ink and the magenta ink in each combination are mixed in any permeation area in the same manner.

It is understood that in order to obtain the above ideal permeation state, in a process in which the inks permeate the surface of the print medium, the cyan ink and the magenta ink need to permeate in a state in which the cyan ink and the magenta ink are fully mixed in the print medium. However, in the example shown in FIGS. 3A and 3B, in the order in which the preceding cyan and the subsequent magenta are ejected as in the present embodiment, the preceding cyan is fixed to an upper layer of the sheet while the subsequent magenta deeply permeates a lower layer of the sheet. Accordingly, the color of the preceding cyan becomes strong.

On the other hand, according to the embodiment of the present invention, permeation of the preceding cyan and the subsequent magenta is controlled, whereby the cyan ink and the magenta ink permeate the sheet in a state in which the cyan ink and the magenta ink are fully mixed.

Firstly, ink permeation will be described.

<Ink Permeation>

In a case where an ink is ejected on a print medium such as a sheet including capillaries, a colorant (a dye or a pigment) which contributes to a color appearance permeates the print medium with a carrier (a solvent or water) which carries the colorant. In this behavior of the ink, the colorant remains and is fixed in the upper layer, and the carrier disappears since the carrier permeates a lower portion of the print medium and disperses and evaporates, and finally, the colorant which contributes to the color appearance is fixed. As a larger amount of the colorant is fixed at a shallower position of the surface layer of the sheet, the colorant appears more intensely.

A permeation speed Ka in a print medium can be represented by the following Lucas-Washburn equation (the equation for capillary permeation).

$$Ka = \sqrt{\frac{d\gamma\cos\theta}{4\eta}} \qquad \text{[Mathematical Equation 1]}$$

$$l = Ka\sqrt{t}$$

l: Permeation Distance
d: Capillary Diameter
γ Surface Tension
η Viscosity
θ Contact Angle
t Time
Ka: Permeation Speed Further, the present inventors, et al. find that an ink permeation area of a print medium can be made to approach an ideal state by performing control so that the ink permeation speeds Ka of a preceding ink and a subsequent ink have a specific relative relationship.

In the following, as one configuration, the ink permeation speed Ka is controlled via an ink temperature T. Then a relative relationship between the ink permeation speeds Ka of a preceding dot and a subsequent dot is controlled so that the state of the permeation area is set and thus a color is determined.

Firstly, explanation will be made on controlling the ink permeation speed Ka by using the ink temperature T as a control factor.

<Temperature Dependence of Ink Permeation Speed>

Figure 5:
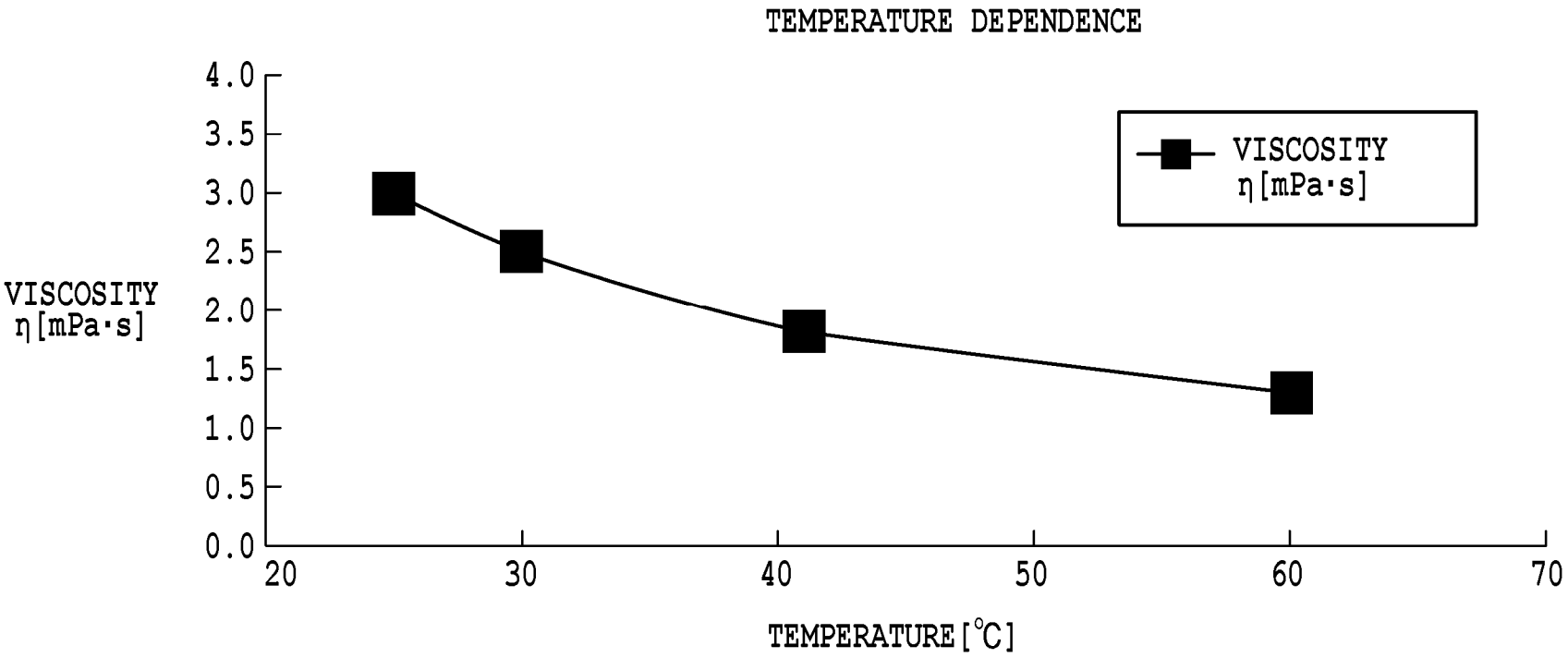
FIG. 5 is a graph showing a change in viscosity $\eta$ [mPa·s] at the time of changing an ink temperature.

According to Mathematical Equation 1 above, the permeation speed Ka depends on the viscosity η and the surface tension γ and thus depends on its ratio (γ/η). The present inventors, et al. firstly investigated the temperature dependence of the viscosity η. FIG. 5 is a graph showing a change in the viscosity η [mPa·sec] when changing the ink temperature. As shown in FIG. 5, in a case where the temperature T=25[° C.], η=3.0 [mPa·sec]; in a case where T=30 [° C.], η=2.5; in a case where T=41 [° C.], η=1.8; in a case where T=60 [° C.], η=1.3; and as the ink temperature increases, the viscosity decreases. As the ink temperature increases from 25 [° C.] to 41 [° C.], the viscosity η decreases drastically and as the ink temperature increases from 41 [° C.], the viscosity η decreases moderately.

Figure 6:
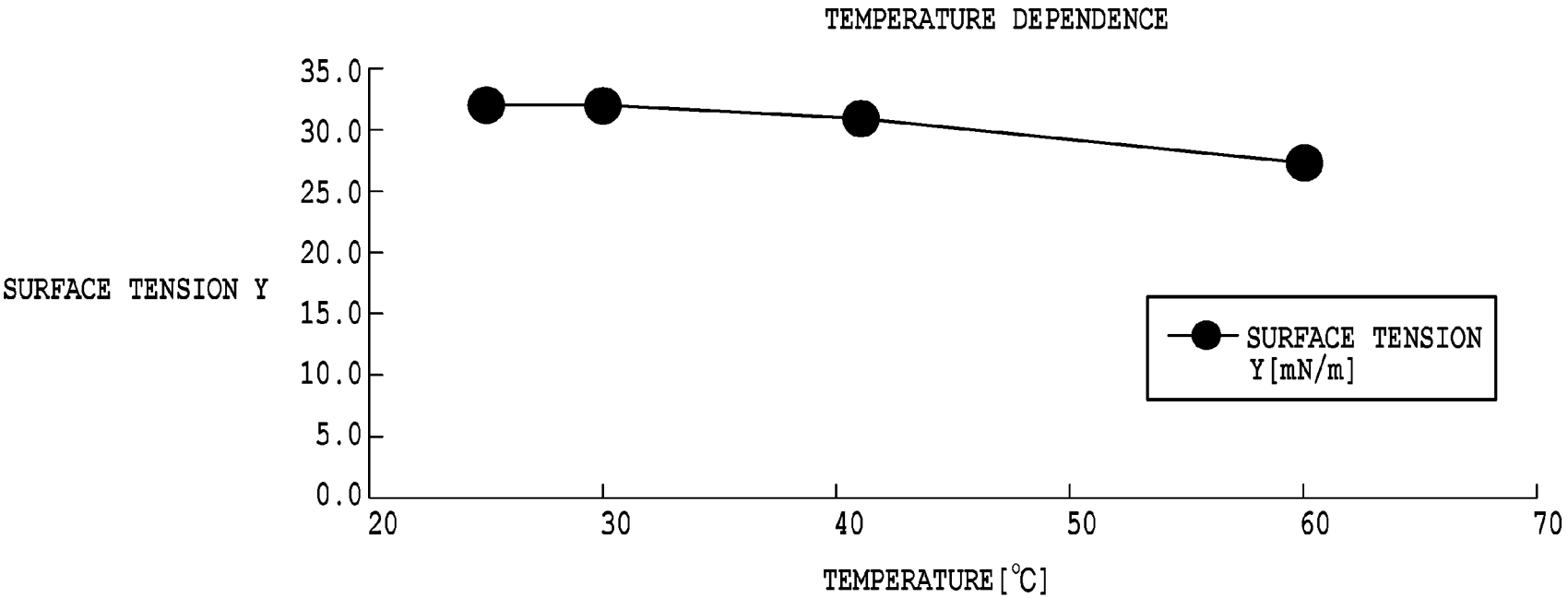
FIG. 6 is a graph showing a change in surface tension $\gamma$ [mN/m] at the time of changing an ink temperature.

Next, the temperature dependence of the surface tension γ was investigated. FIG. 6 is a graph showing a change in the surface tension γ [mN/m] when changing the ink temperature. As shown in FIG. 6, in a case where the temperature T=25 [° C.], the surface tension γ=32.0 [mN/m]; in a case where T=30 [° C.], γ=31.9; in a case where T=41 [° C.], γ=30.8; in a case where T=60 [° C.], γ=27.3; and as the ink temperature increases, the surface tension decreases, though not so much as the viscosity. As the ink temperature T increases from 25 [° C.] to 41 [° C.], the surface tension γ decreases relatively moderately and as the ink temperature increases from 41 [° C.], the surface tension γ decreases at a larger rate.

The ink permeation speed Ka [$ml/m^2(msec)^{12}$] can be calculated by using the viscosity η and the surface tension γ which are the physical properties obtained according to the ink temperature as described above.

Figure 7:
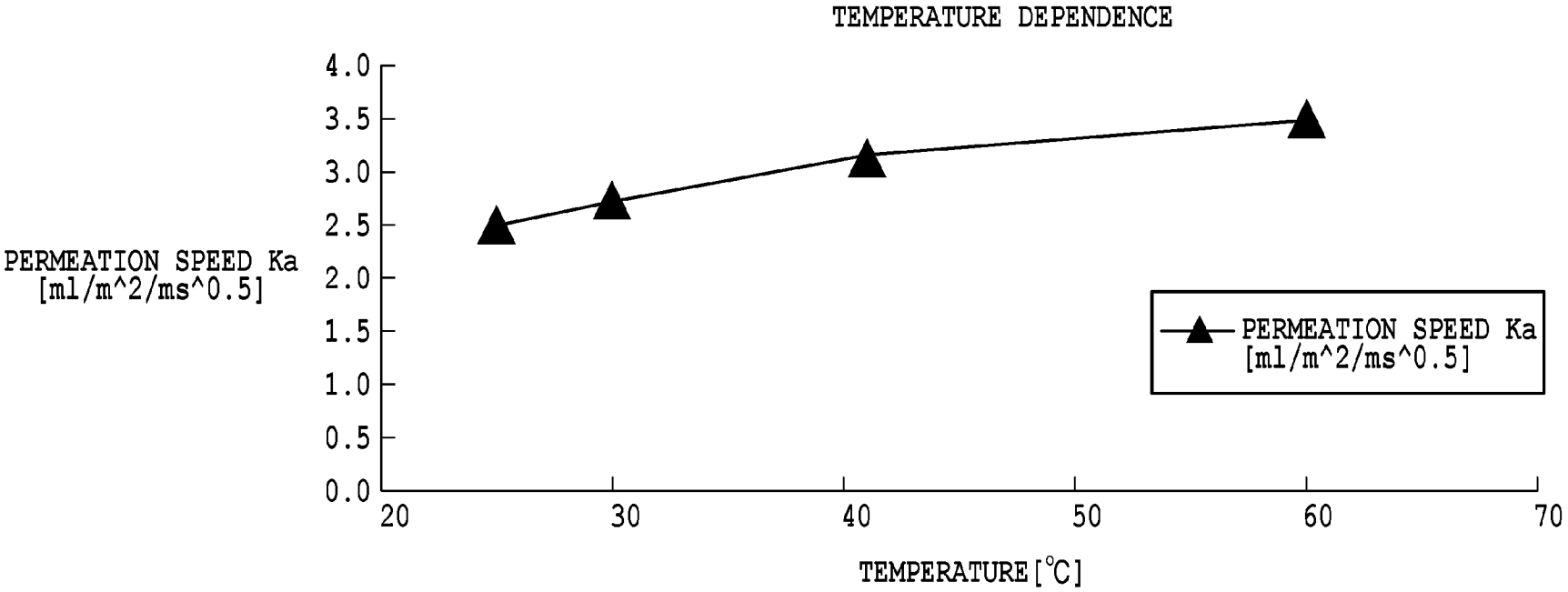
FIG. 7 is a graph showing a change in ink permeation speed Ka [$ml/m^2(ms)^{1/2}$] at the time of changing an ink temperature.

FIG. 7 is a graph showing a change in the ink permeation speed Ka [$ml/m^2(ms)^{1/2}$] when changing the ink temperature. As shown in FIG. 7, in a case where the temperature T=25 [° C.], the ink permeation speed Ka=2.5 [$ml/m^2(ms))^{1/2}$]; in a case where T=30 [° C.], Ka=2.7; in a case where T=41 [° C.], Ka=3.2; in a case where T=60 [° C.], Ka=3.5; and as the ink temperature increases, the ink permeation speed Ka increases.

Table 1 shows the ink viscosity 1 [mPa·s], the surface tension γ [mN/m], and the ink permeation speed Ka [ml/m$^2$ (ms)$^{1/2}$] for the varying ink temperatures as described above.

TABLE 1

| Temperature [° C.] | Viscosity η[mPa · s] | Surface Tension γ[mN/m] | Permeation Speed Ka [ml/m^2/ms^0.5] |
|---|---|---|---|
| 25 | 3.0 | 32.0 | 2.5 |
| 30 | 2.5 | 31.9 | 2.7 |
| 41 | 1.8 | 30.8 | 3.2 |
| 60 | 1.3 | 27.3 | 3.5 |

Next, explanation will be made on ink permeation at the ink permeation speed Ka for the print medium which is obtained based on the ink temperature and its ink permeation area.

<Ink Temperature and Permeation Area>

FIGS. 8A to 8D are cross-sectional views schematically showing the ink permeation area of the print medium at the time of changing the ink temperature.

Figures 8A, 8B, 8C, 8D:
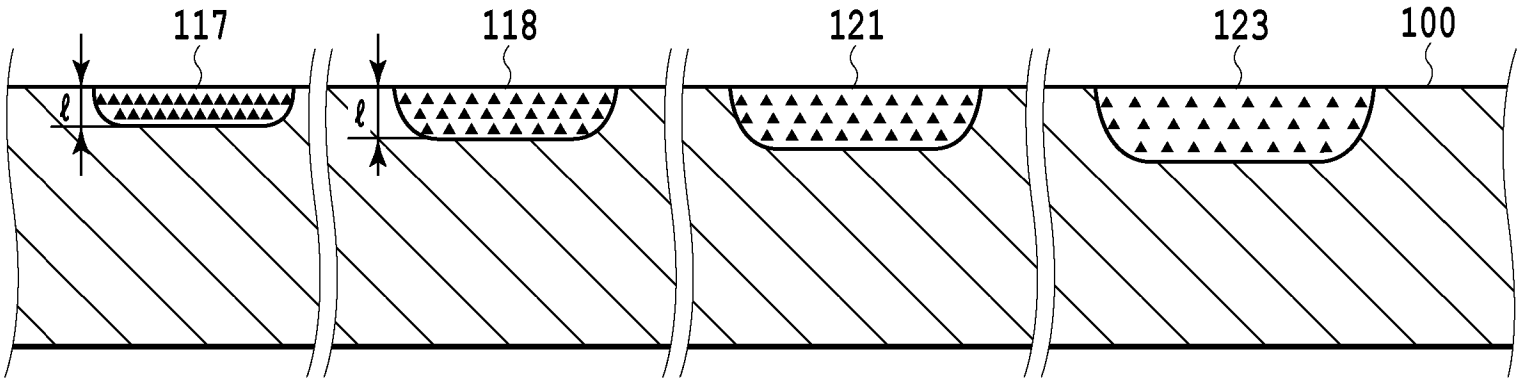
FIGS. 8A to 8D are cross-sectional views schematically showing an ink permeation area of a print medium at the time of changing an ink temperature.

FIG. 8A shows an ink permeation area 117 obtained in a condition in which the ink temperature T=25 [° C.] which is a normal temperature and the permeation speed Ka=2.5 [ml/m$^2$ (msec)$^{1/2}$].

FIG. 8B shows an ink permeation area 118 obtained in a condition in which the ink temperature T is increased to 30 [° C.]. According to FIG. 7 or Table 1, in a case where T=30 [° C.], Ka=2.7 [ml/m$^2$(msec)$^{1/2}$], which is 1.08 times as large as Ka in a case where T=25 [° C.]. Accordingly, a permeation depth l for a unit time is 1.08 times as large as the one in a case where T=25. Further, since ink spreads substantially isotropically at the permeation speed Ka, the volume of the ink permeation area is increased by 1.26 (=(1.08)$^3$) times. On the other hand, even in a case where the ink temperature is changed, the amount of liquid (the amount of permeation) included in the print medium because of permeation remains substantially the same. Accordingly, in a case where the permeation speed increases, the capillary occupancy rate by the ink in the print medium decreases. Assuming that the capillary occupancy rate by the ink in the print medium in a case where T=25 [° C.] is 100%, the occupancy rate in a case where T=30 [° C.] is 80% (=1/1.26).

Likewise, the permeation speed Ka in a case where T=41 [° C.] is 1.26 times as large as the permeation speed Ka in a case where T=25[° C.]. Accordingly, the volume of the ink permeation area increases 2.0 (=(1.26)$^3$) times, and the capillary occupancy rate p by the ink in the print medium is 50%. Therefore, a permeation area 121 obtained in a condition in which T=41 [° C.] becomes the one shown in FIG. 8C. According to FIG. 8C, the volume of the permeation area is about two times as large as the one in a case where T=25 [° C.] as shown in FIG. 8A. Further, the volume ratio of an area where the ink occupies the capillary as schematically shown by "black triangles" in FIG. 8C is about half of that of the area shown in FIG. 8A.

The permeation speed Ka in a case where T=60 [° C.] is 1.4 times as large as the permeation speed Ka in a case where T=25 [° C.], the volume of the ink permeation area increases 2.74 (=(1.4)$^3$) times, and the capillary occupancy rate p by the ink is 36%. More specifically, FIG. 8D shows a permeation area 123 obtained in a condition in which T=60 [° C.].

The embodiment of the present invention defines a relationship between the permeation speeds Ka of the preceding cyan ink and the subsequent magenta ink and a relationship (magnitude relationship) between the capillary occupancy rates p of the preceding cyan ink and the subsequent magenta ink in the print medium based on the ink temperature T as described above. This controls the permeation area when printing is performed with the preceding cyan and the subsequent magenta, thereby controlling the color appearance realized by the inks which are ejected in an overlapping manner.

FIGS. 9A to 9F are diagrams for explaining several examples in which color appearances are determined by controlling the temperatures of a preceding cyan ink and a subsequent magenta ink to control permeation states according to the embodiment of the present invention.

Example 1

Case where the Diameter of the Preceding Ink and the Diameter of the Subsequent Ink are the Same In Example 1, evaporation in a micro area can be ignored, and permeation of the preceding cyan and the subsequent magenta realizes a color whose color reproduction area is not distorted.

Figures 9A, 9B:
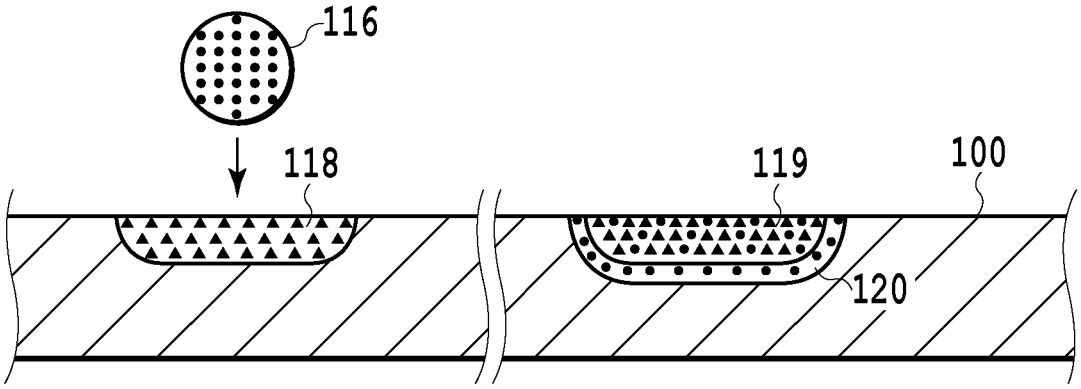
FIGS. 9A to 9F are diagrams for explaining several examples in which colors are determined by controlling the temperatures of a preceding cyan ink and a subsequent magenta ink to control permeation states according to an embodiment of the present invention.
Figures 9C, 9D:
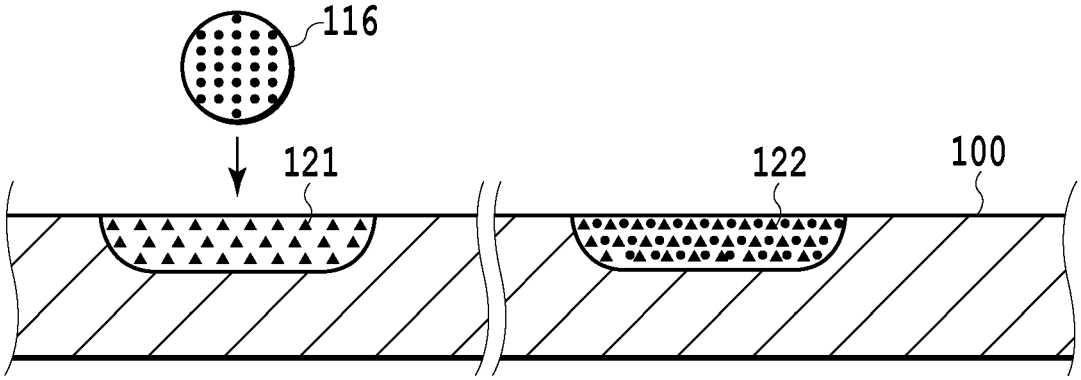

FIG. 9C shows a permeation area in which the preceding ink permeates and a state in which the subsequent ink lands (is ejected) in Example 1. In this example, a feedback temperature control is performed using the sub-heater 35 based on a temperature read from the temperature sensor 31 so that the temperature Tc of the preceding cyan ink ejected from the print head 7 becomes 41 [° C.]. With this control of increasing the ink temperature, the volume Vc of a permeation area 121 is two times as large as that of the permeation area 117 in a case where Tc=25 [° C.] (FIG. 8A) and the capillary occupancy rate Pc by the ink in the sheet is 50%.

In the permeation state shown in FIG. 9C, the subsequent magenta 116 is ejected. Control is performed so that the temperature Tm of the subsequent magenta ink ejected from the print head 8 becomes 25 [° C.]. The amount of an ink which can be absorbed by the area of the print medium in which the preceding cyan already permeates is 50% (0.5) of the volume of the permeation area in which the preceding cyan permeates, the volume being 2.0 times as large as the volume in a case where the ink temperature is 25[° C.]. Accordingly, 2.0×0.5=1.0 time. More specifically, in a case where the ink temperature is 25 [° C.], the permeation state at this temperature itself can be realized and the temperature Tm of the magenta ink is controlled at 25 [° C.]. This enables the subsequent magenta to permeate a void area (50%) of capillary in an area overlapping the permeation area Vc in which the preceding cyan permeates. As a result, the subsequent magenta permeates in a state shown in FIG. 9D. As shown in FIG. 9D, the permeation area in which the preceding cyan permeates as shown by "black triangles" and the permeation area in which the subsequent magenta permeates as shown by "black circles" exist in equal amounts in a mixed state to realize a permeation area 122.

The permeation area 122 in which the preceding cyan and the subsequent magenta exist in equal amounts in a mixed state as described above becomes the already-described ideal permeation area. Accordingly, it becomes possible to suppress generation of distortion of a color reproduction area caused by the order in which color ink droplets are ejected.

To sum up the conditions for Example 1, in a case where the permeation speed Kap of the preceding ink and the permeation speed Kan of the subsequent ink have relationships Kap>Kan and Kap=2$^{1/3}$(Kan), it is possible to perform printing with stable colors by mixing the preceding ink and the subsequent ink.

Example 2

Case where the Diameter of the Preceding Ink is Larger than the Diameter of the Subsequent Ink In Example 2, a final permeation area of a sheet includes a permeation area in which only the preceding cyan permeates as well as an area in which the preceding cyan and the subsequent magenta exist in a mixed state to realize permeation states.

Figures 9E, 9F:
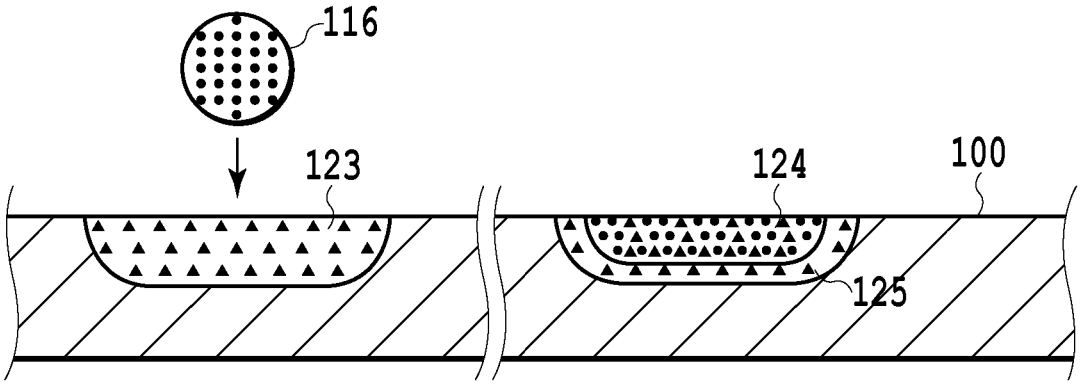

A feedback temperature control is performed by using the sub-heater 35 based on a temperature read from the temperature sensor 31 so that the temperature Tc of the preceding cyan ink ejected from the print head 7 becomes 60 [° C.]. With this control of increasing the ink temperature is increased, as shown in FIG. 9E, the volume Vc of a permeation area 123 is 2.75 times as large as the volume of the permeation area 117 obtained in a condition in which Tc=25 [° C.] and the capillary occupancy rate Pc by the ink is 36%. The permeation depth l of the permeation area 123 in which the preceding cyan permeates, the permeation area being obtained in a condition in which the temperature Tc is 60 [° C.] as shown in FIG. 8D is 1.40 times as large as that of the permeation area obtained in a condition in which T=25 [° C.] (FIG. 8A). On the other hand, the capillary occupancy rate by the ink becomes lower. The amount of the ink which can be further absorbed by the permeation area 123 in which the preceding cyan permeates is 1.75 (=2.75×(1−0.36)) times as large as the amount of the ink which can be absorbed by the permeation area obtained in a condition in which Tc=25 [° C.]. More specifically, in a case where the ink whose temperature T is 25 [° C.] is used, the amount of the ink which can be absorbed by the permeation area 123 is 1.75 times as large as the amount of the ink which can be absorbed by the permeation area 117. The subsequent magenta 116 is ejected on the permeation area 123 in which the preceding cyan permeates. Control is performed so that the temperature Tm of the subsequent magenta ink ejected from the print head 8 is 25 [° C.]. Accordingly, as shown in FIG. 9F, the subsequent magenta spreads through 64% of the capillary which is an unoccupied portion of the permeation area 123 in which the preceding cyan permeates to form a permeation area 124 in which the preceding cyan and the subsequent magenta exist in a mixed state. Further, a permeation area 125 in which only the preceding cyan permeates remains to surround the mixture area 124. In the permeation area 124 in which the cyan and the magenta exist in a mixed state, the cyan accounts for 36% and the magenta accounts for 64%, and accordingly, the permeation area 124 is blue tinged with magenta. The permeation area 125 in which only the preceding cyan permeates is cyan. More specifically, as shown in FIG. 9F, there are formed the permeation area 124 in which the permeation area (36%) in which the preceding cyan permeates as represented by "black triangles" and the permeation area (64%) in which the subsequent magenta permeates as represented by "black circles" exist in a mixed state and the permeation area 125 in which only the cyan permeates. In this case, although the preceding cyan and the subsequent magenta are combined, blue tinged with magenta is realized on a macro level.

To summarize Example 2 above, in a case where the permeation speed Kap of the preceding ink is larger than the permeation speed Kan of the subsequent ink (Kap>Kan), it is possible to realize the area of the ideal state in which the preceding ink and the subsequent ink are printed in a mixed state as described above. In addition, in a case where Kap>2[1/3](Kan), there is formed a permeation area in which the color of the subsequent ink is dominant as well as the permeation area of the above ideal state.

Example 3

Case where the Diameter of the Subsequent Ink is Larger than the Diameter of the Preceding Ink In Example 3, as final permeation areas of a sheet, there are formed an area in which the preceding cyan and the subsequent magenta exist in a mixed state and a permeation area in which only the subsequent magenta permeates. In this example, temperature control is performed so that the temperature Tc of the preceding cyan ink ejected from the print head 7 becomes 30 [° C.]. In a case where the ink temperature is increased, the volume Vc of the permeation area 118 is 1.26 times as large as that of the permeation area 117 in a case where Tc=25 [° C.] (FIG. 8A), and the capillary occupancy rate Pc by the ink is 80%. FIG. 9A shows a state in which the preceding cyan ink permeates and then the subsequent magenta ink lands.

In a case where the subsequent magenta is ejected in this permeation state, the amount of the subsequent magenta ink which can be further absorbed by the permeation area 118 in which the preceding cyan permeates is 0.26 (=1.26×(1−0.8)) time as large as the amount of the preceding cyan ink which is absorbed by the permeation area in a condition in which the ink temperature is 25 [° C.]. Therefore, if the magenta ink whose temperature is 25 [° C.] is used, the amount of the subsequent magenta ink which can be further absorbed by the permeation area in which the preceding cyan permeates in a condition in which the ink temperature Tc is 30[° C.] is 0.26 time as large as the amount of the preceding cyan ink which is absorbed by the permeation area in a condition in which the ink temperature Tc is 25 [° C.].

FIG. 9B shows a permeation state in which the subsequent magenta 116 is ejected in the permeation area in which the preceding cyan permeates. Control is performed so that the temperature Tm of the subsequent magenta ink ejected from the print head 8 becomes 25 [° C.]. Accordingly, subsequent magenta spreads through 20% of the capillary which is an unoccupied portion of the permeation area 118 in which the preceding cyan permeates to form a permeation area 119 in which the preceding cyan and the subsequent magenta exist in a mixed state. Further, the permeation area 120 in which only the subsequent magenta permeates is formed beyond the permeation area in which the preceding cyan permeates to enclose the mixture area 119. In the permeation area 119 in which the cyan and the magenta exist in a mixed state, the cyan accounts for 80% and the magenta accounts for 20%, and the permeation area 119 is blue tinged with cyan. The permeation area 120 in which only the subsequent magenta permeates is magenta. In this case, in a permeation process different from a conventional one, blue tinged with cyan which is the same as a conventional color can be realized with a combination of the preceding cyan and the subsequent magenta. As shown in FIG. 9B, there is formed the permeation area 119 in which the permeation area (80%) in which the preceding cyan permeates as represented by "black triangles" and the permeation area (20%) in which the subsequent magenta permeates as represented by "black circles" exist in a mixed state. Further, the permeation area 120 in which only the magenta permeates is formed.

To summarize Example 3 above, in a case where Kap>Kan, the area in which the preceding ink and the subsequent ink are printed in a mixed state can be formed as described above. In addition, in a case where Kap<$2^{1/3}$(Kan), there is formed the permeation area in which the color of the preceding ink is dominant as well as the permeation area of the above mixture state.

Incidentally, in the above descriptions, it is assumed that evaporation in the micro area can be ignored. If the evaporation cannot be ignored, the permeation speed Ka can be set in consideration of the evaporation.

(Second Embodiment)

According to a second embodiment of the present invention, the ink permeation speed Ka is controlled by controlling the ink temperature with Peltier elements. Incidentally, in the descriptions of the present embodiment, elements which are the same as those of the first embodiment are assigned the same reference numerals and their detailed explanations are omitted.

<Controlling the Permeation Speed Ka by Cooling>

Figure 10:
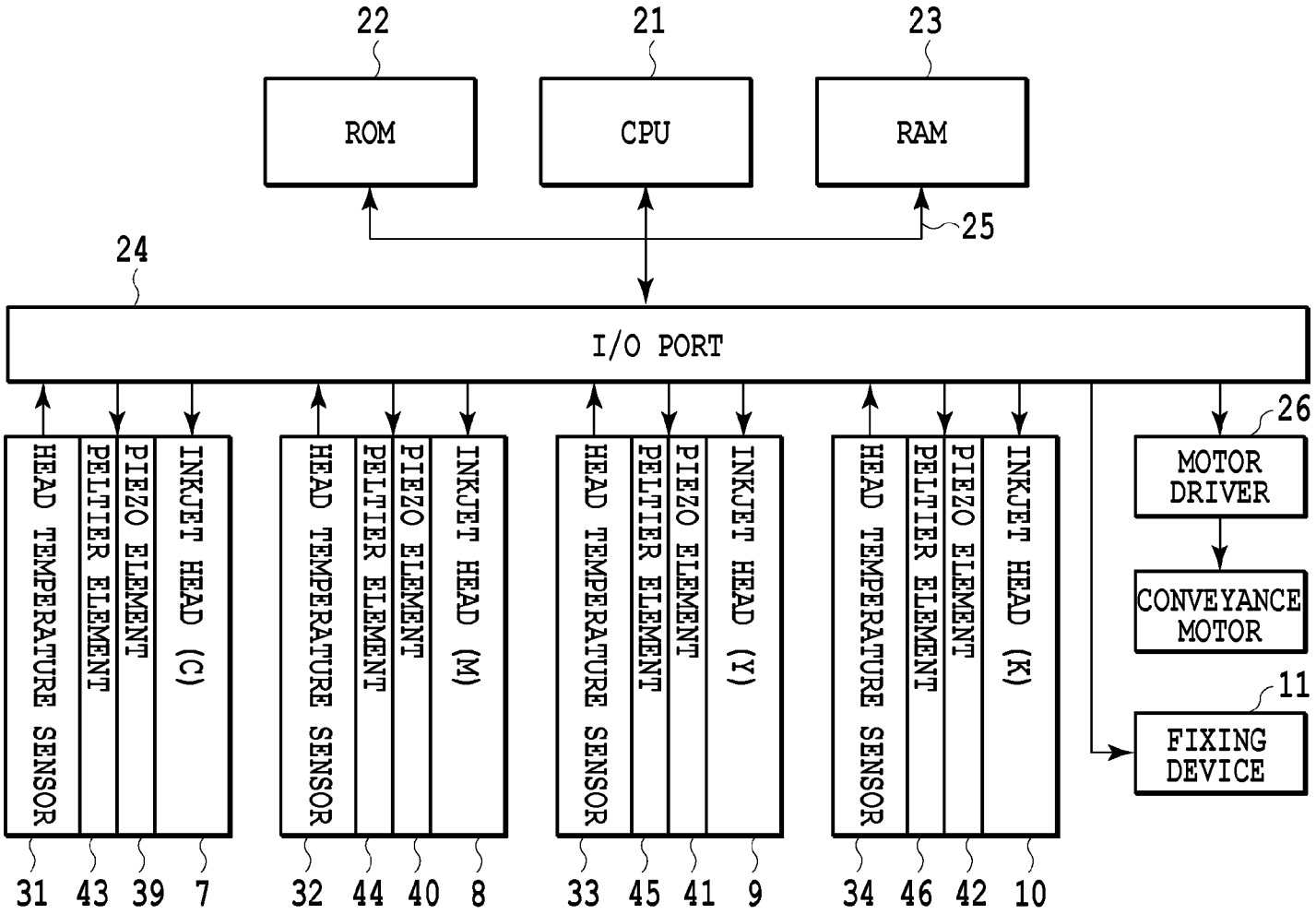
FIG. 10 is a block diagram showing the configuration of a control section using piezo elements and Peltier elements according to a second embodiment of the present invention.

FIG. 10 is a block diagram showing the configuration of a control section using piezo elements and Peltier elements according to the present embodiment. The print head 7 for the cyan ink is provided with a piezo element 39 for imparting mechanical energy necessary for ejecting the ink. Likewise, the print head 8 for the magenta ink is provided with a piezo element 40, the print head 9 for the yellow ink is provided with a piezo element 41, and the print head 10 for the black ink is provided with a piezo element 42. In addition, there are provided Peltier elements (43, 44, 45, and 46) for heating or cooling the inks in the print heads. The print heads (7, 8, 9, and 10) are provided with the temperature sensors (31, 32, 33, and 34) for detecting temperatures, respectively. Incidentally, as is well known, a Peltier element uses a Peltier effect that in a case where two types of semiconductors are joined to thin metal and a current is passed through the thin metal, heat is transferred from one semiconductor to the other semiconductor. A switch between heating and cooling can be made by changing a direction in which the current is passed.

In the present embodiment, the temperatures T of the preceding ink and the subsequent ink can be adjusted by using the Peltier elements. Control is performed so that the permeation speed Kap of the preceding ink is larger than the permeation speed Kan of the subsequent ink, and Kap=$2^{1/3}$(Kan). In a case where a room temperature is 41 [° C.] and the temperature Tc of the preceding cyan is 41 [° C.], for example, the Peltier elements perform cooling control so that the temperature Tm of the subsequent magenta ink is 25 [° C.]. This can create a state in which the preceding ink and the subsequent ink are printed in a mixed state. The ink permeation speed Ka is controlled by performing cooling in the above manner, whereby it becomes possible to use, as a print head member, a member whose thermal resistance is low and to reduce manufacturing cost.

<Controlling the Permeation Speed Ka by Controlling the Physical Properties of the Ink>

Water has high surface tension and has characteristics that general paper is not likely to be wet with water. In this respect, it is necessary to add a substance for enabling water to permeate paper easily. In order to increase the permeation speed, it is possible to add a non-ionic surfactant, a polyhydric alcohol derivative, or a monovalent alcohol which has the effect of lowering a contact angle between a paper surface and an ink droplet. These additives can be used to control the viscosity $\eta$ and the surface tension $\gamma$ of the ink. An adjustment only has to be made so that the permeation speed Kap of the preceding ink is larger than the permeation speed Kan of the subsequent ink and Kap=$2^{1/3}$(Kan). In this manner, control is performed based on the physical properties of the ink, whereby control of a temperature on the side of a print element becomes unnecessary, and it becomes possible to carry out the invention with a simpler configuration. More specifically, the permeation speed of the ink can be controlled by adjusting the physical properties of the ink.

<Variations of the Embodiments>

The above-described embodiments use a full-line head and provide feedback based on temperatures detected by the temperature sensors (31, 32, 33, and 34). More specifically, the embodiments use a thermal inkjet system in which the sub-heaters (35, 36, 37, and 38) maintain the ink temperatures and further the head heaters (27, 28, 29, and 30) are driven to apply thermal energy to eject ink droplets. However, another system can be used to carry out the present invention.

<Printing System>

The above-described embodiments use a line head. However, the present invention can be applied to a case where a serial printing apparatus performs one-way printing in which printing is performed only in a forward path or a backward path. Further, in bidirectional printing, the ink temperature can be controlled in each printing operation, whereby printing is performed without a difference in color between forward and backward scans, for example.

<Number of Colors>

Further, the above-described embodiments use the four print heads as the plurality of print heads, but the present invention is not necessarily limited to the embodiments. The present invention can use two, three, or five or more print heads. Further, regarding the types of inks, the present invention can be applied to the case of using three colors except black, the case of using five or more color inks, and the case of using a plurality of types of black inks as well as the case of using the four colors, cyan, magenta, yellow, and black.

<Printing Element>

As described above, the print head can be a thermal inkjet print head which ejects ink droplets by applying thermal energy and can also be a piezo jet print head which uses a piezo element. In a case where the print head is the piezo jet print head, the temperature can be controlled by providing a heater for heating an ink as well as the piezo element for ejecting an ink.

<Method for Controlling the Temperature of the Ejected Ink>

The above-described embodiments use a system for controlling the temperature based on feedback, but a control method used for temperature control is not limited to this and a publicly-known method can be used. For example, the head member and the heat capacity of an ink can be considered and adjusted so that the temperature of the print head is controlled in a self-balancing manner. In this manner, it becomes unnecessary to use parts required to form a feedback loop such as the sensors and the sub-heaters, and the configuration of the present invention becomes simpler.

Incidentally, it is possible to use, as the self-balancing print head used for the present invention, a thermal insulation print head (thermal insulation head) having a structure which will be described below.

Figure 11A:
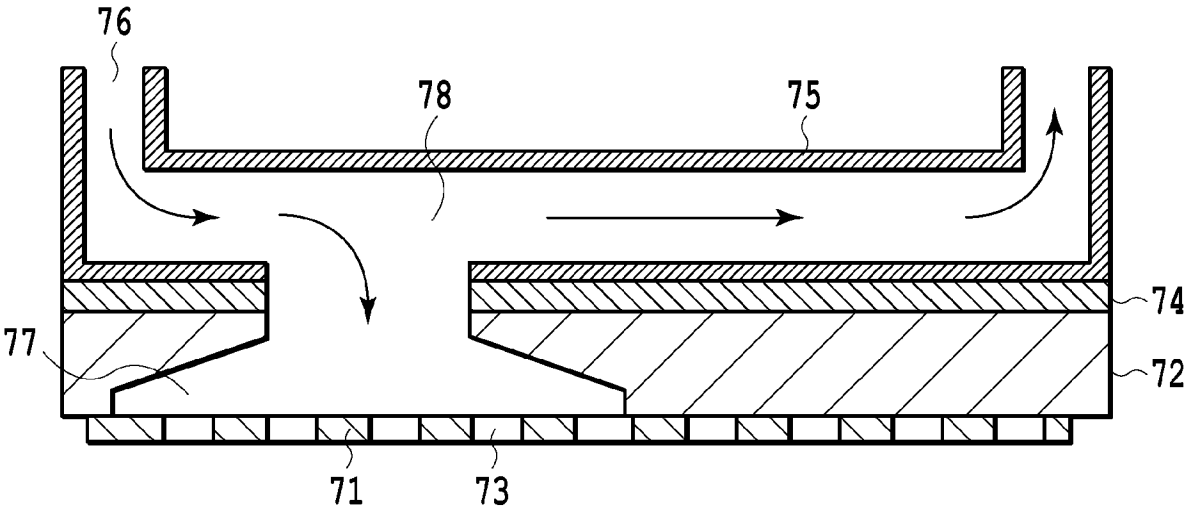
FIGS. 11A and 11B are schematic cross-sectional views showing the schematic structure of a print head according to an embodiment of the present invention.
Figure 11B:
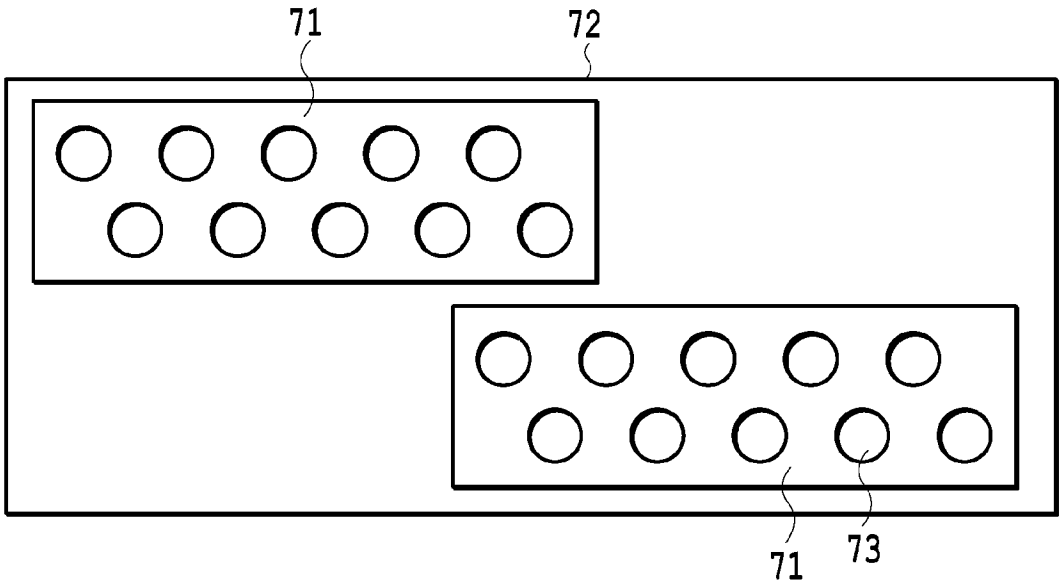

FIGS. 11A and 11B are schematic cross-sectional views showing the schematic structure of a print head according to an embodiment of the present invention.

Firstly, with reference to FIGS. 11A and 11B, explanation will be made on the schematic structure of the inkjet print head of the present embodiment. The print head of the present embodiment ejects an ink downward and two print element substrates 71 each having two arrays of ejection ports for ejecting ink droplets of the same color are arranged on the lower surface of a support plate 72 in a staggered pattern. An individual ink supply path 77 is formed in the support plate 72 for each print element substrate to supply an ink to the arrays of the ejection ports. This support plate 72 is generally formed by using a ceramic material having a low thermal expansion coefficient and appropriate thermal conductivity such as alumina (thermal conductivity: 32 W/mK). A thermal insulation portion 74 formed of a plate member is bonded and fixed to the upper surface of the support plate 72 and a communication port is formed in each print element substrate to supply an ink to the individual ink supply path 77. The print heads for ejecting inks of the other colors also have the same structure.

The thermal insulation portion 74 is formed by using a material having a thermal expansion coefficient almost equal to that of the support plate 72 and thermal conductivity lower than that of the support plate 72, such as polyphenylene sulfide (PPS, thermal conductivity: 17 W/mK) which is thermoplastic plastic. A common liquid chamber 78 for storing an ink in a negative pressure state is formed on the upper surface of the thermal insulation portion 74 and is tightly fixed to prevent ink leakage.

Next, explanation will be made on a path for supplying an ink to each print element substrate. An ink introduced from an ink introduction port 76 to the print head flows in the common liquid chamber 78 in a longitudinal direction of the print head (an arrangement direction of the print element substrate) and subsequently flows into the communication port formed in the thermal insulation portion 74. Further, the ink is supplied to ejection port arrays 73 of the print element substrate 71 in an odd-number row through the individual ink supply path 77. The same can be said for a path for supplying an ink to the print element substrate 71 in an even-number row.

Next, explanation will be made on a transmission path for heat generated in the print element substrates 71 in a case where an ink is ejected. A remaining amount obtained by subtracting heat brought to the outside of the print head by ejected ink droplets and motion energy for ejecting the ink droplets from power supplied to the print element substrates 71 for ejecting an ink is used to generate heat in the print element substrate 71. Further, this heat in the print element substrate 71 whose heat amount decreases by the amount of heat released into the air is propagated to the support plate 72. Even in a case where the flow of an ink in the common liquid chamber 78 increases a thermal transmission coefficient, a rate is small at which heat is transmitted to the ink in the common liquid chamber 78 via the thermal insulation portion 74 having high thermal resistance. Accordingly, the heat accumulated in the support plate 72 is absorbed mainly by the ink flowing through the individual ink supply paths 77 or released to the air from the side surface of the support plate 72. Therefore, even in a case where printing is performed at a higher speed and a larger amount of heat is generated, the present embodiment can reduce, to a lower level, the amount of heat transmitted from an upstream side of the print element substrate to a downstream side of the print element substrate via the ink flowing through the common liquid chamber 78 as compared with a conventional inkjet print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-135009, filed Jun. 27, 2013, which is hereby incorporated by reference herein in its entirety.

What is claimed is:

1. An inkjet printing apparatus comprising:

a print head unit for ejecting at least an ink of a first color and an ink of a second color different from the first color on a print medium; and a print control unit configured to control the print head unit to precedently eject the ink of the first color on the print medium and subsequently eject the ink of the second color on the ink of the first color precedently ejected on the print medium in an overlapping manner;

wherein the print control unit controls a temperature of each of the ink of the first color and the ink of the second color so that a permeation speed at which the ink of the first color permeates the print medium is larger than a permeation speed at which the ink of the second color permeates the print medium.

2. The inkjet printing apparatus according to claim 1, wherein the print control unit controls the temperature of each of the ink of the first color and the ink of the second color, whereby capillary occupancy rates of the ink of the first color and the ink of the second color in the print medium are changeable, the capillary occupancy rates being determined by a volume of the ink permeation area and a permeation amount of ink obtained at the permeation speed.

3. The inkjet printing apparatus according to claim 2, wherein the print control unit controls the temperature of each of the ink of the first color and the ink of the second color so that the capillary occupancy rate of the ink of the second color is larger than the capillary occupancy rate of the ink of the first color.

4. The inkjet printing apparatus according to claim 2, wherein the print control unit controls the temperature of each of the ink of the first color and the ink of the second color so that the capillary occupancy rate of the ink of the first color is larger than the capillary occupancy rate of the ink of the second color.

5. The inkjet printing apparatus according to claim 2, wherein the print control unit controls the temperature of each of the ink of the first color and the ink of the second color so that the capillary occupancy rate of the ink of the first color is equal to the capillary occupancy rate of the ink of the second color.

6. The inkjet printing apparatus according to claim 1, wherein a Peltier element is used to control the temperature of the ink.

7. The inkjet printing apparatus according to claim 1, wherein the print head unit includes a first print head for ejecting the ink of the first color and a second print head for ejecting the ink of the second color, and in each of the first and second print heads, a plurality of print element substrates having a plurality of ejection ports for ejecting an ink are supported by a supporting member, and are in communication with a common ink flow path, and the supporting member is formed of a material insulating heat transferred through the ink as a heat transfer medium in the plurality of print element substrates.

8. The inkjet printing apparatus according to claim 7, wherein the support member is formed of thermoplastic resin.

9. The inkjet printing apparatus according to claim 1, wherein the print head unit includes n ($n \geq 2$) print heads arranged at predetermined intervals in a conveyance direction of the print medium, and the print control unit controls the print head unit so that the inks of the different colors are sequentially ejected from the plurality of print heads to print the print medium.

10. The inkjet printing apparatus according to claim 9, further comprising a conveying unit for conveying the print medium, wherein a predetermined area of the print medium is printed by that passing the conveying unit conveying the print medium so that the print medium passes one time relative to the fixed print heads.

11. The inkjet printing apparatus according to claim 1, wherein the print control unit controls the temperature of each of the ink of the first color and the ink of the second color so that the temperature of the ink of the first color differs from the temperature of the ink of the second color.

12. The inkjet printing apparatus according to claim 1, wherein the print control unit controls the temperature of each of the ink of the first color and the ink of the second color so that the temperature of the ink of the first color is higher than the temperature of the ink of the second color.

13. The inkjet printing apparatus according to claim 1, further comprising:

individual sensors for detecting the temperature of the ink of the first color and the ink of the second color; and individual heating units configured to heat the ink of the first color and the ink of the second color.

14. An inkjet printing method for performing printing by ejecting inks at least an ink of a first color and an ink of a second color different from the first color on a print medium by a print head unit comprising:

precedently ejecting the ink of the first color on the print medium by the print head unit and subsequently ejecting the ink of the second color by the print head unit on the ink of the first color precedently ejected on the print medium in an overlapping manner;

wherein a temperature of each of the ink of the first color and the ink of the second color is controlled such that a permeation speed at which the ink of the first color permeates the print medium is larger than a permeation speed at which the ink of the second color permeates the print medium.

15. The inkjet printing method according to claim 14, wherein the temperature of each of the ink of the first color and the ink of the second color is controlled, whereby capillary occupancy rates of the ink of the first color and the ink of the second color in the print medium are changeable, the capillary occupancy rates being determined by a volume of the ink permeation area and a permeation amount of ink obtained at the permeation speed.

16. An inkjet printing method according to claim 15, wherein the temperature of each of the ink of the first color and the ink of the second color is controlled so that the capillary occupancy rate of the ink of the first color is equal to the capillary occupancy rate of the ink of the second color.

17. An inkjet printing method according to claim 15, wherein the temperature of each of the ink of the first color and the ink of the second color is controlled so that the capillary occupancy rate of the ink of the second color is larger than the capillary occupancy rate of the ink of the first color.

18. An inkjet printing method according to claim 15, wherein the temperature of each of the ink of the first color and the ink of the second color is controlled so that the capillary occupancy rate of the ink of the first color is larger than the capillary occupancy rate of the ink of the second color.

19. An inkjet printing method according to claim 15, wherein the print head unit includes a first print head for ejecting the ink of the first color and a second print head for ejecting the ink of the second color, and in each of the first and second print heads, a plurality of print element substrates having a plurality of ejection ports for ejecting an ink are supported by a supporting member, and are in communication with a common ink flow path, and the supporting member is formed of a material insulating heat transferred through the ink as a heat transfer medium in the plurality of print element substrates.

20. The inkjet printing method according to claim 14, wherein the temperature of each of the ink of the first color and the ink of the second color is controlled so that the temperature of the ink of the first color differs from the temperature of the ink of the second color.

21. The inkjet printing method according to claim 14, wherein the temperature of each of the ink of the first color and the ink of the second color is controlled so that the temperature of the ink of the first color is higher than the temperature of the ink of the second color.

22. The inkjet printing method according to claim 14, wherein:

individual sensors are used for detecting the temperature of the ink of the first color and the ink of the second color; and individual heating units are used to heat the ink of the first color and the ink of the second color.

23. An inkjet printing apparatus comprising:

a print head unit for ejecting at least an ink of a first color and an ink of a second color different from the first color on a print medium; and a print control unit configured to control the print head unit to precedently eject the ink of the first color on the print medium and subsequently eject the ink of the second color on the ink of the first color precedently ejected on the print medium in an overlapping manner;

wherein the print control unit controls a temperature of each of the ink of the first color and the ink of the second color so that a permeation speed at which the ink of the first color permeates the print medium is larger than a permeation speed at which the ink of the second color permeates the print medium, whereby capillary occupancy rates of the ink of the first color and the ink of the second color in the print medium are changeable, the capillary occupancy rates being determined by a volume of the ink permeation area and a permeation amount of ink obtained at the permeation speed.

* * * * *